United States Patent [19]

Vidal

[11] 4,192,249

[45] Mar. 11, 1980

[54] VESSEL HAVING TWO TUBULAR FLOAT ELEMENTS

[76] Inventor: Henri Vidal, 8 bis, Boulevard Maillot, 92 Neuilly sur Seine, France

[21] Appl. No.: 848,768

[22] Filed: Nov. 4, 1977

[30] Foreign Application Priority Data

Nov. 9, 1976 [FR] France ..... 76 33707

[51] Int. Cl.[2] ..... B63B 1/12

[52] U.S. Cl. ..... 114/61; 9/1.1

[58] Field of Search ..... 9/1.1, 2 A, 2 S, 11 R, 9/347; 115/22, 26; 114/61, 77 R

[56] References Cited

U.S. PATENT DOCUMENTS 1,093,475 4/1914 Rosing ..... 114/61

2,847,961 8/1958 Meckenstock ..... 114/77 R X 4,063,320 12/1977 Neumann et al. ..... 9/2 A

FOREIGN PATENT DOCUMENTS 111190 9/1898 Fed. Rep. of Germany ..... 9/2 A

*Primary Examiner*—Sherman D. Basinger

*Attorney, Agent, or Firm*—Burns, Doane, Swecker & Mathis

[57] ABSTRACT

The vessel comprises a bottom-less support structure which itself ensures the buoyancy of the vessel. The structure has for this purpose hollow volumes integral with the structure and located in places which substantially correspond to the outer contour of a single-hull boat.

2 Claims, 7 Drawing Figures

VESSEL HAVING TWO TUBULAR FLOAT ELEMENTS

The object of the invention is to provide a very strong floating vessel which will behave on the sea like single-hull boats the architecture of which is designed for this purpose (fat in the center and raised at the front and at the rear end) and yet has, as the fragile catamaran, a very low resistance to travel owing to a reduced wet area.

The vessel according to the invention comprises a rigid support structure which itself ensures the buoyancy of the vessel and comprises for this purpose means defining two hollow float parts which define an opening on the longitudinal axis of the vessel and are an integral part of the structure located in places which substantially correspond to the outer contour of a single-hull boat.

The structure according to the invention may in particular have a bi-convex shape in plan and an upwardly concave shape in elevation.

Figure 1:
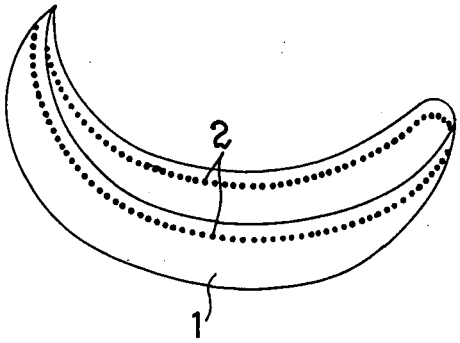
FIG. 1 PRIOR ART
FIG. 1 shows diagrammatically a conventional boat hull on which is indicated in heavy dotted line the approximate position of the volumes which are of the greatest utility for the stability of the boat.

The hull 1 of the caique shown in FIG. 1 comprises a side forming a continuous solid surface all of which is not necessary to ensure the buoyancy and the correct behavior of the vessel on the sea. Generally, solely the marginal zone 2 rather close to the upper outer contour of the hull 1 is useful.

The support structure of the floating vessel according to the invention comprises essentially elements corresponding to the useful zone 2 of FIG. 1.

Figure 2:
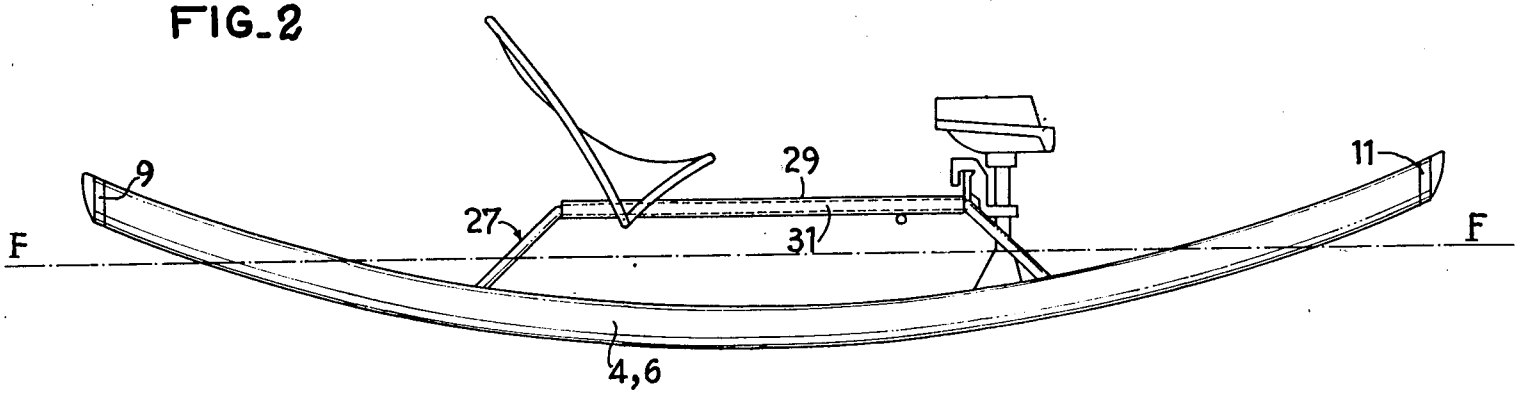
FIGS. 2 and 3 are elevational and plan views of a floating vessel according to the invention.
Figure 3:
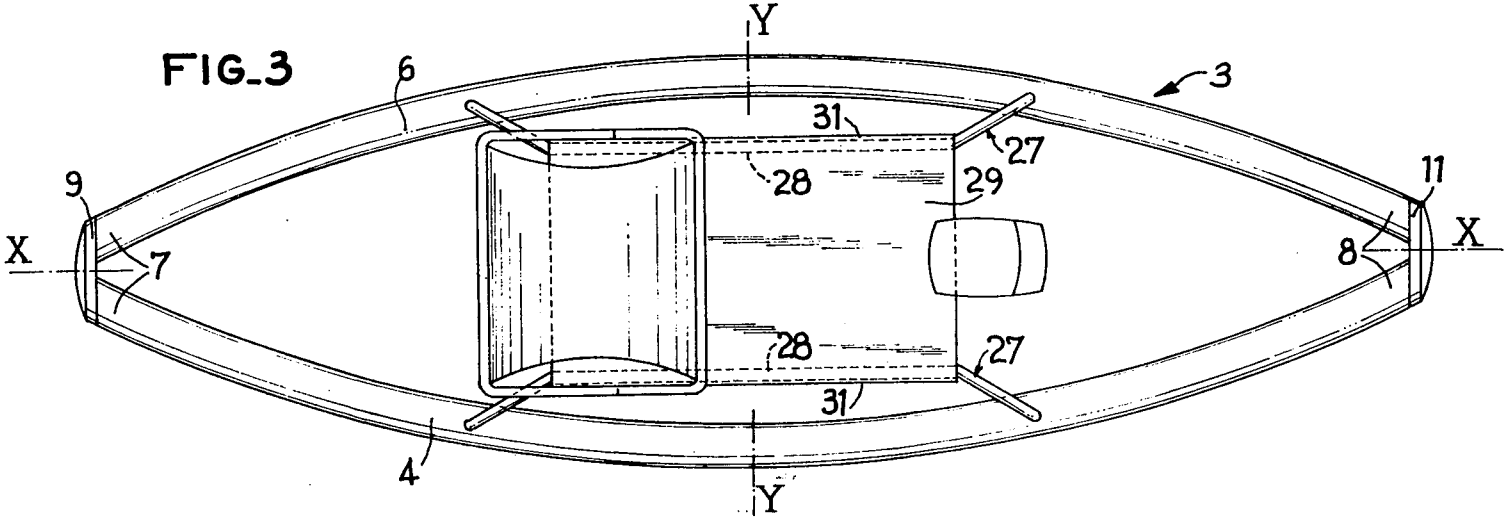

The floating vessel of FIGS. 2 and 3 comprises a support structure 3 defined by two curved tubes or float parts 4, 6 which have their curvature in a single plane and are disposed symmetrically with respect to the longitudinal plane X—X of the vessel. The tubes 4, 6 are interconnected at their ends, namely prow 7 and stern 8, by assembling devices 9, 11 respectively. The two tubes 4, 6 have an upwardly concave curvilinear shape and a downwardly convex curvilinear shape in side elevation and define in plan a bi-convex shape so that they converge toward each other at their ends.

There may be fixed, for example by straps, to each of the tubes 4, 6, an upwardly-extending tubular support or second assembly means 27 of trapezoidal shape comprising a horizontal member 28 located above the water line F—F. There may be secured to the two members 28 a deck or floor 29 provided with two lateral ledges 31 which laterally cover the members 28.

Figure 4:
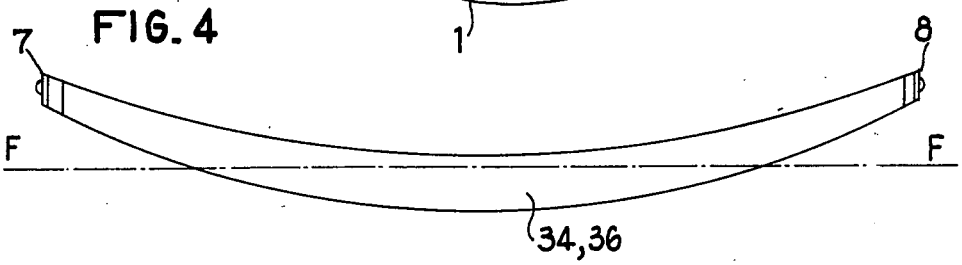
FIGS. 4 and 5 are elevational and plan views of another embodiment.
Figure 5:
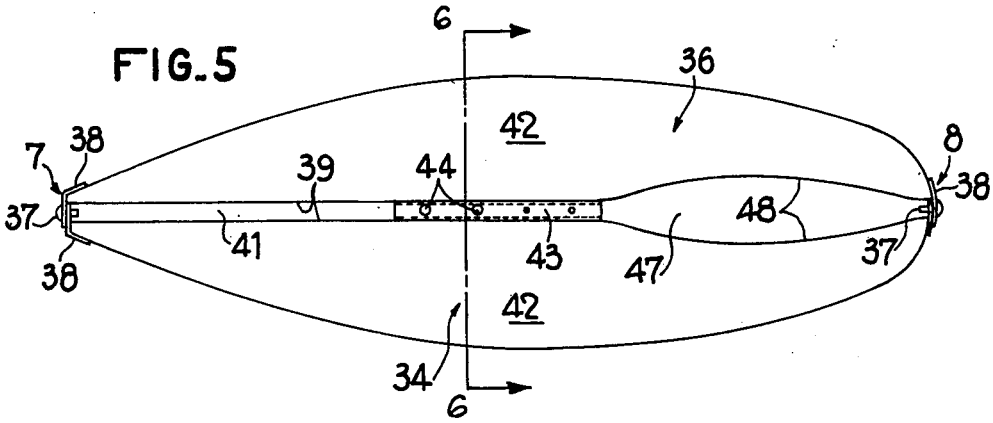
Figure 6:
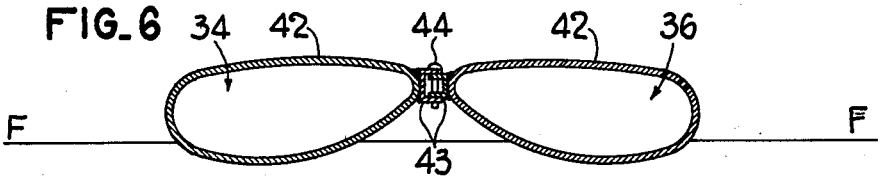
FIG. 6 is a sectional view taken on line 6—6 of FIG. 5.
Figure 7:
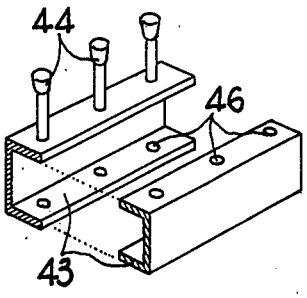
FIG. 7 is a perspective view of means for interconnecting the central part of the tubular elements of FIG. 5.

The support structure of FIGS. 4 to 6 comprises two fluid tight tubular elements or float parts 34, 36 which have a varying cross-section and an upwardly concave curvilinear shape and a downwardly convex curvilinear shape in side elevation and define a bi-convex shape in plan and taper toward their ends 7, 8 where they are assembled by assembling means comprising a pin 37 which extends through an inner flange of two members 38 fixed to the respective elements. The inner edges 39 of the elements are substantially rectilinear and form a relatively narrow gap 41.

The top 42 of the elements is transversely flat or slightly convex so as to define a deck or floor which, in the central zone of the elements, fills the gap 41 owing to the fact that there are secured to the respective inner edges 39 two U-section members 43 which are fitted one inside the other and assembled rigidly by pins 44 which extend through aligned apertures 46 in the flanges of these section members. The structure comprising the element 43, 44 and 46 constitutes consequently assembling means for the two float parts 34 and 36.

The gap 41 is widened at 47, to facilitate the placement of a motor, by means of recesses 48 formed in the inner edges 39 of the elements.

The support structure therefore comprises three zones of rigid connection between the elements 34, 36 namely at the ends and in the central part thereof.

Having now described my invention what I claim as new and desire to secure by Letters Patent is:

1. A floating vessel comprising a rigid support structure which is elongate and has a prow and a stern and constitutes the means whereby the vessel floats, said support structure comprising means defining two rigid fluidtight hollow elongate tubular float parts which extend from the prow to the stern of the support structure and define an opening of the support structure, each of said float parts having relative to a vertical axial plane of the vessel an outer convex contour in plan, the outer contours of the two float parts in plan tapering toward and substantially meeting at the prow and stern of the support structure and thereby imparting to the support structure substantially a shape in plan of a conventional single-hull boat which tapers at both ends, the two float parts having in side elevation an upwardly concave curvilinear shape on an upper side and a downwardly convex curvilinear shape on a lower side of the float parts, first assembling means above the water line interconnecting the float parts at the prow and stern of the support structure and second assembling means intermediate and spaced from said first assembling means for rigidly interconnecting the two float parts, said opening extending throughout the height of the vessel between said first assembling means at said prow and stern and said second assembling means, and said opening having a width transversely of the vessel which is a minor part of the overall width of the support structure substantially throughout the length of the support structure, the tubular float parts each having a varying cross-sectional shape and widening in plan in the region of said second assembling means and a transversely substantially rectilinear upper contour whereby upper surfaces of the float parts substantially define a deck.

2. A vessel as claimed in claim 1, wherein said deck is transversely continuous in the region of said second assembling means which comprise two overlapping upper portions integral with the respective tubular elements.

* * * * *